United States Patent [19]

Gallart

[11] 4,279,141

[45] Jul. 21, 1981

[54] POWER TOOL

[76] Inventor: Robert Gallart, 107 Pershing Ave., Locust Valley, N.Y. 11560

[21] Appl. No.: 13,517

[22] Filed: Feb. 21, 1979

[51] Int. Cl.[3] ..... B21D 1/12; B21D 37/04

[52] U.S. Cl. ..... 72/482; 72/481; 72/705; 254/93 R

[58] Field of Search ..... 72/392, 705, 481, 482, 72/407; 254/93 HP, 93 R, 93 H, 104, 51; 81/302, 389, 3 K, 180 R

[56] References Cited

U.S. PATENT DOCUMENTS

| | | | |
|---|---|---|---|
| 884,422 | 4/1908 | Schmitt | 81/389 X |
| 1,319,007 | 10/1919 | Kind | 81/302 X |
| 2,296,173 | 9/1942 | Mandl | 72/392 |
| 2,341,278 | 2/1944 | Long | 254/93 H UX |
| 2,443,931 | 6/1948 | Stultz | 72/705 X |
| 2,585,158 | 2/1952 | Morgenthaler | 72/705 X |
| 2,588,509 | 3/1952 | Forster | 72/705 X |
| 2,620,737 | 12/1952 | Miller | 254/51 X |
| 2,643,562 | 6/1953 | Geddes | 254/104 X |
| 2,690,323 | 9/1954 | Evenson | 254/104 |
| 3,635,440 | 1/1972 | Gompel | 254/93 R |

FOREIGN PATENT DOCUMENTS

| | | | |
|---|---|---|---|
| 2358986 | 5/1975 | Fed. Rep. of Germany | 72/705 |

*Primary Examiner*—Lowell A. Larson
*Attorney, Agent, or Firm*—Kenneth E. Merklen

[57] ABSTRACT

Each jaw of a pair of jaws of an expandable jaw power tool are individually modified so as to accept a shaft supported in one jaw while passing through the other jaw of the same pair. The shaft includes an adjustable power distributing member which makes the depth of the jaws adjustable and makes greater use of the power stroke of the jaws, distributes the power or pressure output of the jaws over a wider area and makes an improved power tool, adjustable at the point of application of power stroke.

6 Claims, 9 Drawing Figures

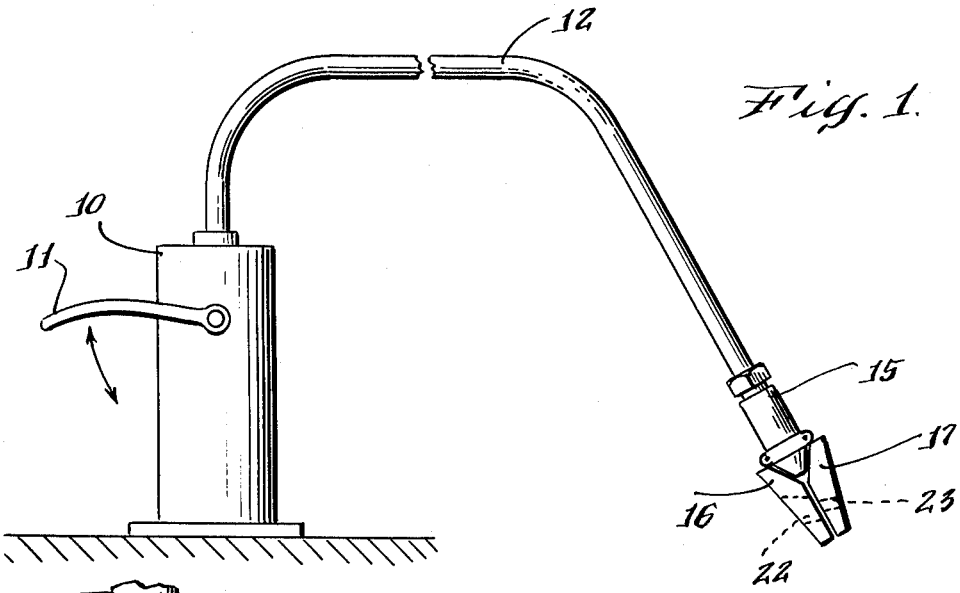
Fig. 1.
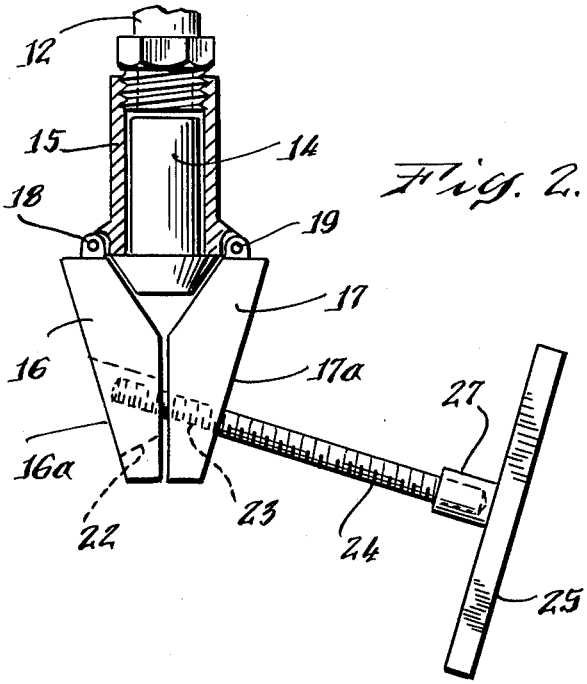
Fig. 2.
Fig. 2a
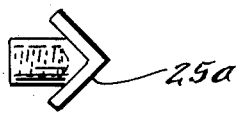
Fig. 2b
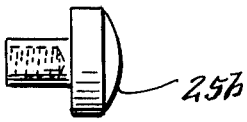
Fig. 2c
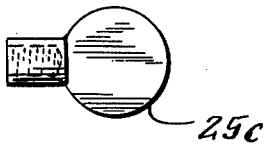
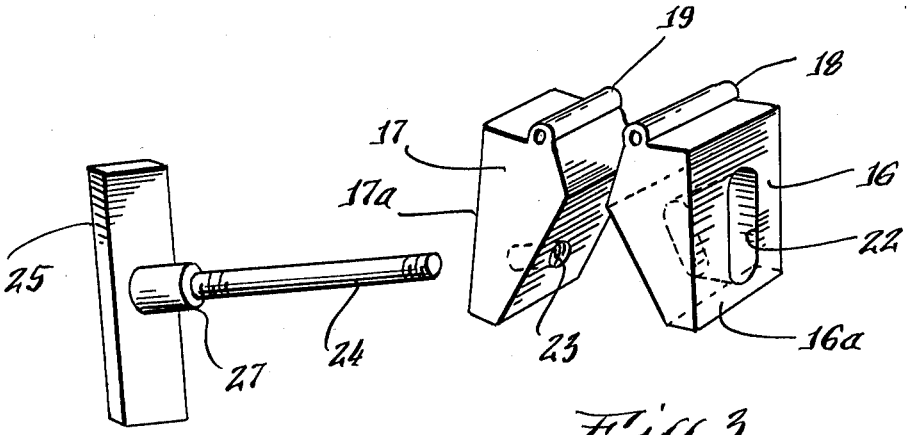
Fig. 3.

POWER TOOL

The present invention relates to an attachment tool usable in conjunction with an expandable jaw power tool, the like of which finds great utility in motor vehicle collision repair and particularly in straightening out dented metal surfaces of doors, panels, fenders, hands and/or trunk lids and/or other metal surfaces on damaged motor vehicles.

PRIOR ART

The field of motor vehicle collision repair makes use of various methods for straightening or flattening metal surface of automobiles and other motor vehicles which have been damaged such as dented, bent and/or disfigured by collision or otherwise. One way to repair dented metal surfaces is to back the surface to be repaired with a block and hammer the surface thus simulating a hammer and anvil. This often requires two persons to do such job. In addition the hammered surface of the metal tends to stretch at and around the point of impact of the hammer. Another method of prior art is to put holes in the surface of the dented area and use a "pull-hammer" to straighten the surface. This method provides inserting a rod through the hole and clamping the rod on the back of the metal surface so that it does not pull through the metal. Then by using a sliding weight one can "pull-hammer" the metal to its original form. However, after the metal is straightened, the holes must be filled using a plastic or metal filler.

A more modern method is the use of expandable jaws, using pneumatic or hydraulic power to drive a piston between the pair of jaws to separate the jaws thereby expanding jaws. This tool is used with a fair amount of success and ease in straightening bent, dented and/or twisted metal. However, due to the fact that the jaws are driven open by a solid piston and the work area, such as the door or other panel of an automobile is relatively small and narrow in the work area, and, since the tool must be portable, the jaws of the power tool are small and narrow and area of the metal actually worked upon during straightening is very small. Thus, work is done, when using this tool, in small incremental steps. In addition, the distance from fully closed to full expansion of the pair of jaws is often not of sufficient travel to make contact with the inside surface of the interior panel, of a door, for example, and the inside surface of the outside panel, so that a block is often required.

SUMMARY

The present invention is an attachment usable with a pair of modified power jaws which makes adjustable the normally shallow depth of the expandable jaws so as to avoid the need of using a block. The present invention also provides a means of adjustably extending the surface over which pressure is applied by the pair of power jaws when being actuated. In addition, the present attachment when used with a pair of expandable jaws provides a backing surface or an anvil effect of sufficient size so as to be effective as an interior anvil when hammering of the exterior surface is required.

The jaws of a power expansion tool are modified in that one jaw is fitted with a tapped hole to receive a threaded shaft. The other jaw of the pair of jaws is slotted so that the threaded shaft may float freely up through the second of the jaws as the pair of jaws expand from their pivot points. To the threaded shaft is a power transmitting member which applies the expansion power of the jaws over a larger effective surface than the jaw to which it is attached. The power transmitting members may be in the form of a bar connected at normal to the threaded shaft. The connection between the power transmitting bar and the threaded shaft may be solid, such as a brazed or welded connection or may be a threaded connection which provides rotational adjustability or may be a clamp connection that accords full adjustability of the angular position between the threaded shaft and the power transmitting bar while the feature of the threaded shaft screwed into the tapped hole of one jaw with the ability to pass floatingly through the other jaw, via the slotted hole, of the pair of jaws provides jaws with an adjustable depth while maintaining maximum use of the power stroke or expansion power of the pair of jaws. Thus, when the described attachment is connected to the jaws of an expandable jaw power tool the power tool becomes a more useful tool, becoming adjustable in depth so as to obtain maximum use out of the expansion power while expanding the area over which pressure is applied. In addition, universal adjustability of the power transmitting bar provides for selective application of the transmitted power or pressure and, as additional feature provides a practical internal anvil.

OBJECTS

It is an object of the present invention to provide a more useful, adjustable expandable jaw power tool.

Another object is to provide an expandable jaw power tool which is functionally adjustable in depth of the jaws.

Another object is to provide an expandable jaw power tool in which the effective expansion pressure or power of the jaws is extended over a larger area.

Still another object of the invention is to provide an improved expandable jaw power tool in which the power applicator is adjustable with respect to application of pressure or power.

While another object is to provide an improved expandable jaw power tool which may serve as an internal anvil for providing a base or backing for external hammering.

These and other objects, which may become apparent from reading the following description are found in a tool having primary utility in motor vehicle collision repair work but is not necessarily limited to such use.

BRIEF DESCRIPTION OF THE DRAWINGS

FIG. 1 is a side view of an expandable jaw power tool;

FIG. 2 is a graphic representation of the present invention;

FIGS. 2*a*, 2*b* and 2*c* illustrate alternate structures or contours of the power transmitting member;

FIG. 3 illustrates the modified jaw set with one form of power transmitting member;

DESCRIPTION OF INVENTION

Figure 4:
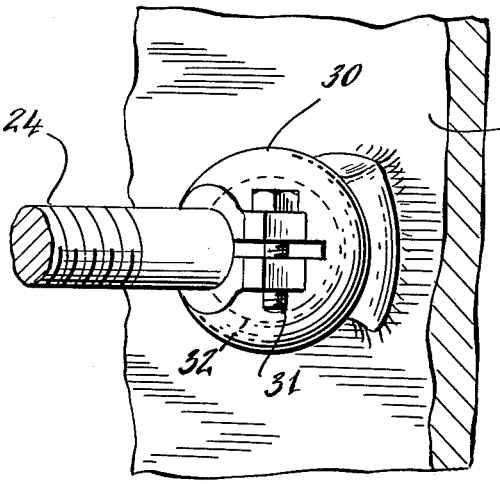
FIG. 4 illustrates an adjustable coupling for a power transmitting member.

FIG. 1 illustrates an expandable jaw power tool in which hydraulic power, generated in the pump 10, by actuation of the handle 11. The hydraulic fluid is pumped through the hose 12 to the base of the piston 14 supported in the cylinder 15. The cylinder serves as a ram which is forced between the pair of jaws 16 and 17. The jaws are pivotally coupled to the end of the cylinder 15 by hinges 18 and 19 respectively. As the cylinder 14 is forced in between the jaws 16 and 17 the jaws are forced open applying an expanding force or pressure exerted from the outside of the jaws to anything in which the jaws come in contact.

FIG. 2 shows the power jaws, in the improved preferred form, where jaw 17 has a threaded or tapped hole 23 and jaw 16 has a smooth wall slot 22, more clearly seen in FIG. 3. A threaded shaft 24 is screwed into the tapped hole 23 and, if screwed sufficiently far into the hole in jaw 17, may enter the slot 22 in jaw 16. The slot 22 is sufficiently large so that the shaft 24 may float in the slot 22. The slot 22 is elongated so that as the jaws 16 and 17 are separated by the advancing piston 14 the shaft 24 may float freely in the slot 22. The depth of the jaws 16 and 17 is seen as the distance from surface 16*a* to 17*a* when the jaws are closed.

By providing the tapped hole 23 and the float-slot 22 the present invention provides adjustability of jaw depth with respect to the jaw depth with respect to the application of the power or pressure exerted by the jaws.

At the end of the shaft 24 is a power or pressure distribution member 25. This pressure or power distribution member may be attached substantially permanently to the end of shaft 24 as by welding or brazing the shaft 24 and the member 25 together. However, it is preferred that the power distribution member 25 be removable and thus a screw coupling 27 is shown as may be used.

The power or pressure distribution member 25 may be in the form of a bar and may take any one of several contours such as shown in FIGS. 2*a*, 2*b* and 2*c* as 25*a* an angle bar, 25*b*, a curved edge bar and 25*c*, a round shaped bar, respectively. Also, power distribution members of various length may be used, the length being suitable for the job, as desired, by merely substituting one for the other.

It is also to be noted that although the preferred form of the invention provides for a tapped hole in one jaw and a slotted hole in the other jaw, both jaws may be provided with tapped holes and two shafts may be used, one shaft screwed into each jaw, with corresponding power distribution members attached to the shafts. This construction may be used where it is desired to essentially double the effective depth of the jaws or for other reasons which are obvious to the user of such tool.

FIG. 4 illustrates a ball and socket connection which is attached to the power distribution member 25. The socket 30 may be attached to the member 25 and the shaft 24 may be inserted in the socket and the socket closed about the shaft end by means of tightening the split socket with the bolt and nut combination 31/32. This type of coupling is particularly useful where universal adjustability and quick removal is desired.

Figure 5:
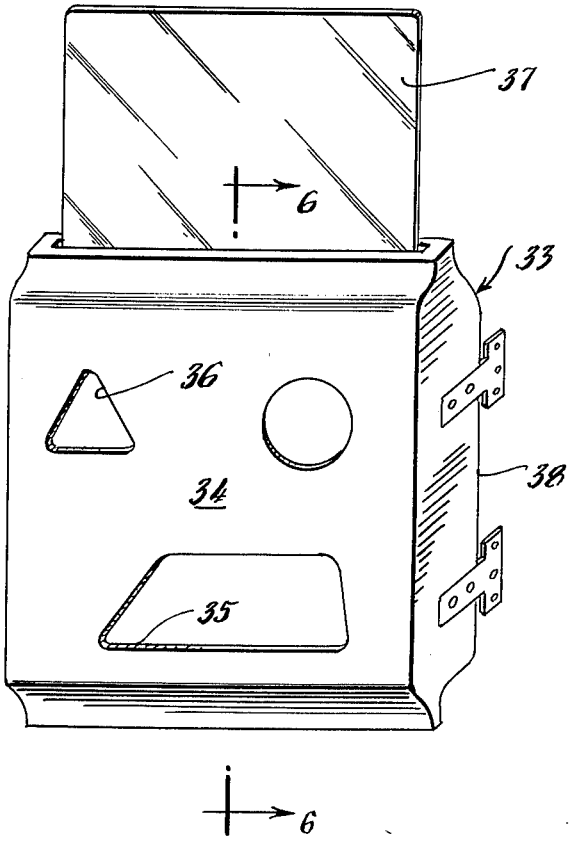
FIG. 5 shows in graphic perspective an inside view of a motor vehicle door and FIG. 6 is a view along line 6—6 of FIG. 5 of the internal part of a motor vehicle door with the present invention in use therein.

FIG. 5 illustrates a door of a motor vehicle as viewed from the inside where the interior decorative panel has been removed. Note that the access holes 35 and 36 on the inside panel 34 permit access to the interior of the door 33. The hole 36 would serve to permit the crank (not shown) for the window 37 to pass through the inside panel 34 so as to permit operation of the window raising and lowering mechanism, not shown.

Figure 6:
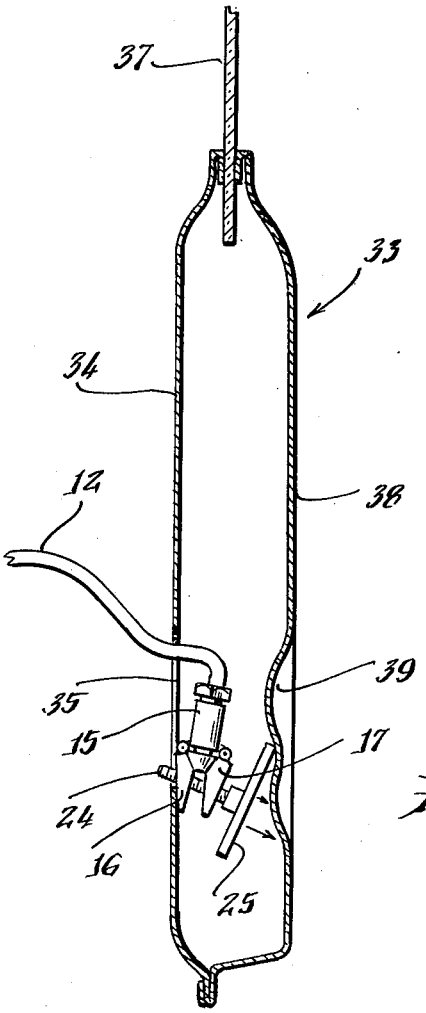

FIG. 6 illustrates how the present invention may be used in straightening out a dented door. For purposes of illustration it is here assumed that the outside panel 38 of the door 33 was damaged. FIG. 6 shows the interior of the door 33, the outside panel being shown as 38, having the dented contour shown in solid line with the original contour shown as broken line 39. In order to straighten the outside panel 38 the present invention may be inserted into the interior of the door via access hole 35 and located so that jaw 16 abuts the inside panel. The inside panel then serves as a block or stop for the jaw 16. The jaw 17 with the power distribution member 25 and shaft 24 are located against the dented part of the outside panel 38 of the door. As the jaws 16/17 expand due to the cylinder 14 forcing the jaws apart, the expansion power of the jaws is transmitted to the power distribution member 25 which presses or forces the dented portion of the door panel 38 back toward its original contour 39.

It can be seen that without the present invention a separate block would be required to serve as a stop. This would require shifting the position of the jaws, while holding the block in place, as opposed to functionally increasing the depth of the jaws. Also, the area which may be expanded by the prior art jaws is small when compared to the area over which the expansion force is distributed by the present invention. It can be further seen that when in expanded condition the power distribution member may serve to function as an anvil located in the interior of the door which will permit further straightening of the panel through use of a hammer.

Thus, the preferred structure and several alternate structures of the present invention has been described, without limitation thereto, along with one example of use which shows its several advantages over prior art. The invention has its preferred use in association with hydraulic or pneumatic power although the piston 14 may be forced between the jaws 16/17 by use of other forms of power, as will be obvious to those skilled in the art.

What is claimed is:

1. An improved expandable jaw power tool, said tool including a piston moveable in a cylinder, force means coupled to said cylinder for driving said piston between a pair of spreadable jaws, said jaws coupled to said cylinder for pivotally separating when said piston is driven between said jaws by said force means said improvement including:

a tapped hole extending through one jaw of said pair of jaws, said tapped hole retaining of threaded shaft, a slotted hole extending through the second jaw of said pair of jaws and substantially in alignment with said tapped hole in said one jaw, and of sufficient inside diameter for passing said threaded shaft therethrough, said threaded shaft screw-coupled into said tapped hole and of sufficient length for extending into said slotted hole and a power distributing bar coupled to said shaft and secured thereto for remotely applying expansion power between said second jaw and said bar which is normally applied between said one jaw and said second jaw.

2. An improved expandable jaw power tool as in claim 1 and in which the coupling between said threaded shaft and said power distributing bar includes:

an adjustable socket coupled to said power distributing bar and adapted to receive a rounded end of a shaft and wherein one end of said threaded shaft is without threads and rounded so as to fit into said socket.

3. Apparatus for expanding the power thrust generated by an expandable jaw power tool, said power tool having a source of power for pivotally spreading a pair of jaws for applying an expansion power at the extremes of said jaws, said apparatus including:

a tapped hole extending through one jaw of said pair of jaws, a slotted hole in the other jaw of said pair of jaws, said tapped hole generally in alignment with said slotted hole at all times, a threaded shaft screw-coupled into the threads in said tapped hole for coupling said threaded shaft into said one jaw for moving in unison therewith, and a power distributing bar coupled at normal to said threaded shaft for remotely applying said expansion power normally applied between said pair of jaws during expansion thereof to between said other jaw and said power distributing bar.

4. Apparatus for expanding the power thrust generated by an expandable jaw power tool as in claim 3, and in which said power distributing bar is of predetermined length and of angular configuration.

5. Apparatus for expanding the power thrust generated by an expandable jaw power tool as in claim 3 and in which said power distributing bar is of predetermined length and of spherical configuration.

6. Apparatus for extending the width of expansion power of a pair of jaws of an expandable jaw power tool and for remotely applying said expansion power beyond the normal travel of said pair of jaws, said apparatus including:

a threaded shaft screw coupled into a tapped interior wall, a first hole extending through one jaw of said pair of jaws, the interior wall of said hole tapped for retaining said threaded shaft screw-coupled thereto, said shaft being of sufficient length for extending substantially beyond the confines of said first hole, a slotted hole extending through the other jaw of said pair of jaws and of sufficient inside diameter to permit said threaded shaft to enter said slotted hole freely, said slotted hole and said first hole in substantial alignment for permitting the extension of said threaded shaft coupled to said tapped hole to freely enter said slotted hole and, a bar coupled to said threaded shaft for transferring expansion power normally applied between said pair of jaws to between said other jaw and said bar through said threaded shaft screw-coupled to the interior wall of said first hole.

* * * * *